United States Patent [19]

Okada et al.

[11] 3,944,144

[45] Mar. 16, 1976

[54] METHOD AND APPARATUS FOR DISPERSING SUSPENSIONS

[75] Inventors: Akira Okada, Fujiidera; Ryoji Izumi, Neyagawa; Syogo Ninomiya, Itami; Yukio Tahara, Toyonaka; Yuji Takehara, Nishinomiya; Masaaki Suezawa, Matsubara; Kazuhiro Kawasaki, Ibaraki, all of Japan

[73] Assignee: Dai Nippon Toryo Co., Ltd., Osaka, Japan

[22] Filed: June 10, 1974

[21] Appl. No.: 478,167

[30] Foreign Application Priority Data

June 13, 1973 Japan ..... 48-66520

[52] U.S. Cl. ..... 241/22; 241/27; 241/46.11

[51] Int. Cl.[2] ..... B02C 17/16

[58] Field of Search ..... 241/15, 21, 22, 24, 26, 241/27, 30, 46.06, 46.11, 46.15, 124

[56] References Cited

UNITED STATES PATENTS

| | | | |
|---|---|---|---|
| 1,956,293 | 4/1934 | Klein et al. | 241/21 X |
| 2,581,414 | 1/1952 | Hochberg | 241/22 |
| 2,764,359 | 9/1956 | Szeguari | 241/15 |
| 3,131,875 | 5/1964 | Szeguari | 241/27 |
| 3,309,030 | 3/1967 | Mölls et al. | 241/21 |
| 3,337,140 | 8/1967 | Wahl | 241/21 |
| 3,799,455 | 3/1974 | Szeguari | 241/27 |

*Primary Examiner*—Granville Y. Custer, Jr.
*Attorney, Agent, or Firm*—Haseltine, Lake & Waters

[57] ABSTRACT

This invention relates to a method for dispersing a suspension of solid particles into the colloidal state, which comprises charging grinding media and said dispersion into a vessel so that the volume ratio of the grinding media and the suspension is within a range of from 2/1 to ½ and agitating the suspension and the grinding media by rotating one agitation rod mounted on the tip end of an agitation shaft at the lower part of the central portion of the vessel so that the peripheral velocity of the tip of the agitation rod is within a range of from 6 to 20 m/sec. The invention also is directed to an apparatus for practicing this method.

10 Claims, 22 Drawing Figures

METHOD AND APPARATUS FOR DISPERSING SUSPENSIONS

BACKGROUND OF THE INVENTION

1. Field of the Invention:

This invention relates to a method for dispersing suspensions and an apparatus for practicing this method.

More particularly, the invention relates to a novel method for dispersing suspensions, which comprises charging a suspension of solid particles such as paints and inks in a cylindrical vessel packed with a number of small grinding media, mixing the suspension with the grinding media, and agitating the suspension together with the grinding media by means of an agitator having one agitation rod, which is disposed in the interior of said vessel, to thereby disperse the suspension in the colloidal state, and to an apparatus for use in practicing this method.

2. Description of the Prior Art:

As dispersion means for dispersing suspensions such as paints and inks, there have heretofore been employed an apparatus having an agitation shaft provided with one or several discs or vanes having a specific shape and an apparatus having an agitation shaft provided with several agitation rods. As typical instances of such conventional apparatus, there can be mentioned a sand mill (disclosed in the specifications of U.S. Pat. Nos. 2,581,414 and 3,185,398), an Attritor (trademark for a dispersion apparatus manufactured by Union Process Company, U.S.A.), and the like.

In the sand mill, a suspension is continuously fed into the interior of a cylindrical vessel from the bottom thereof, and during passages through the interior of the vessel, the suspension undergoes the action of a number of grinding media (for example, glass beads or synthetic ceramic balls having an average size of 0.7 to 3.0 mm) packed in the vessel and several disc-like agitation vanes provided on an agitation shaft disposed in the cylindrical vessel and rotated at a high speed corresponding to a peripheral speed of at least about 10 m/sec, and suspension is dispersed by high "shearing stress" developed by the grinding media. The dispersed suspension is separated from the grinding media by means of a mesh screen mounted in the interior of the cylindrical vessel, and then it is withdrawn in the dispersed state.

The dispersion apparatus of this type, however, includes defects such as mentioned below:

1. Unless the agitation shaft is rapidly rotated at a velocity of at least 800 rpm and a peripheral velocity of at least about 10 m/sec, the suspension is not effectively dispersed. This structural limitation results in the following disadvantages:

1. Because of excessive wearing of the inner wall of the cylindrical vessel, the mesh screen and the grinding media, the maintenance cost becomes high.

2. In the case of a suspension of a high content of solid particles or a suspension of a high viscous resistance, the temperature is extremely elevated, and in some cases, the degree of the temperature elevation is extremely high. Therefore, sufficient temperature control cannot be accomplished, with the result that a great deviation is brought about in the quality of products. Accordingly, this apparatus cannot be applied to suspensions including a composition having a high temperature sensitivity.

3. When an agitation shaft provided with several disc-like agitation vanes is rotated at a high speed, a high agitation resistance is imposed and much power is required for the high speed agitation. Accordingly, the capacity is naturally limited in the dispersion apparatus of this type, and the maximum capacity is about 250 liters in commercially available apparatuses of this type.

2. As is apparent from the dispersing mechanism in the apparatus of this type, it is difficult to disperse a suspension containing solid masses and large agglomerates, and therefore, it is sometimes necessary to disentangle such masses or agglomerates sufficiently in a preliminary kneading step prior to the treatment by the apparatus.

3. Some solid materials cannot be finely dispersed by the apparatus of this type, and in such case it is necessary to use another dispersing machine in addition to the apparatus of this type.

4. The range of a viscosity of the suspension applicable to the apparatus of this type is very narrow, and unless the viscosity is within a range of 85 KU to 120 KU (as measured at 25°C. by a Stormer viscometer), sufficient dispersion is not obtained or it takes a long time to complete dispersion.

5. Unless the specific gravity of the suspension is lower than that of the grinding media contained in the cylindrical vessel, it is quite impossible to accomplish dispersion or it takes a long time to complete dispersion.

6. Provision of accessory equipment such as the above-mentioned pre-treatment equipment (for preliminary kneading) and the post-treatment equipment (for dissolution and color adjustment) is indispensable in the dispersion apparatus of this type. Therefore, the equipment cost becomes high and a large space is necessary for accommodation of the apparatus of this type.

In the Attritor, several columnar agitation rods are provided at prescribed intervals with a certain angle on an agitation shaft disposed in a cylindrical vessel, and the agitation shaft is rotated at a relatively low speed corresponding to a peripheral speed of about 3 m/sec. By the rotation of this agitation shaft, as in the case of the above-mentioned sand mill, a number of grinding media (for example, synthetic ceramic or steel balls having an average size of 3 to 12 mm) and the suspension undergo the moving action of the agitation shaft, and the suspension is dispersed by high shearing stresses formed by the grinding media.

The dispersion apparatus of this type, however, includes the following defects:

1. Although agitation is conducted at a relatively low speed, since relatively heavy media such as synthetic ceramic or steel balls having an average size of at least 3 mm are employed, much power is required for agitation and hence, the capacity of the apparatus is naturally limited. The maximum capacity is about 1000 liters (net capacity of 600 liters) in commercially available apparatuses of this type.

2. Since grinding media composed of a heavy and rigid material are employed, the inner wall of the vessel is readily worn and such disadvantages as contamination and discoloration of products are brought about by incorporation of iron powder.

3. Prior to the treatment by the apparatus, it is necessary to disentangle masses and agglomerates and make the suspension homogeneous in a pre-treatment step (preliminary kneading).

4. Convection currents of the suspension are so mild that the apparatus cannot be used as a mere mixer (for incorporation of a pigment or the like).

As another instance of a dispersion apparatus recently developed, there can be mentioned the dispersion apparatus marketed under the tradename of "Polymill" by J.H. Day Company (disclosed in Paint and Varnish Production, October issue, 1972, pages 6 to 7, published by Palmerton Publishing Co., Incorp., U.S.A.). Glass bead grinding media are employed also in this apparatus, and the suspension is dispersed by rotating a disc having a specific convex and concave shape in a mixture of the grinding media and suspension. Defects involved in the above-mentioned sand mill are similarly observed in the dispersion apparatus of this type.

Further, there is known an apparatus in which the suspension is dispersed by agitation of one disc impeller (see U.S. Pat. No. 3,416,740), a dispersion method in which the suspension is agitated in grinding media with several agitation rods mounted on one agitation shaft in random directions (see U.S. Pat. No. 2,764,359), and similar apparatuses and methods. However, the above-mentioned defects cannot be overcome by any of these conventional techniques.

SUMMARY OF THE INVENTION

This invention has now been achieved as a result of our research work made with a view to improving and overcoming the above-mentioned defects involved in the conventional techniques, and this invention relates to a method for dispersing suspensions which comprises agitating and mixing a suspension together with a number of small grinding media packed in a dispersion vessel by means of one agitation rod, and to an apparatus practicing this method.

It is a primary object of this invention to provide a method in which a large quantity of a suspension can be dispersed in a short time into the fine colloidal state and an apparatus for practicing this method.

Another object of this invention is to provide a suspension-dispersing method in which the pre-treatment step, the dispersing step and the post-treatment step can be performed substantially in one vessel, and an apparatus for practicing this method. In other words, a secondary object of this invention is to shorten the manufacturing steps and reduce the equipment cost and the equipment space.

Still another object of this invention is to provide a suspension-dispersing method in which a variety of suspensions differing in viscosity in a very broad range can be dispersed and homogeneous products can be obtained without deviation of the quality, and an apparatus for practicing this method.

More specifically, in accordance with one aspect of this invention, there is provided a method for dispersing suspensions which comprises charging grinding media and a suspension containing solid particles in a vessel so that the grinding media/suspension volume ratio is within a range of from 2/1 to ½ and agitating the suspension and griding media by rotating one agitation rod mounted on the tip end of an agitation shaft at a lower part of the central portion of the vessel so that the peripheral velocity of the tip end of the agitation rod is within a range of from 6 to 20 m/sec, to thereby disperse the suspension in the colloidal state.

In accordance with another aspect of this invention, there is provided an apparatus for dispersing suspensions, which comprises a vessel, grinding media contained in said vessel, an agitation shaft driven by driving means and disposed in the central portion of said vessel and one agitation rod mounted on the tip end of said agitation shaft at a right angle to said agitation shaft, wherein said agitation rod is disposed at a point vertically spaced from the bottom of the vessel by a distance corresponding to 5 to 20% of the inner diameter of said vessel, the length of said agitation rod corresponding to 65 to 95% of the inner diameter of said vessel and the thickness of said agitation rod being 2 to 5% of the length of the agitation rod.

BRIEF DESCRIPTION

DESCRIPTION OF PREFERRED EMBODIMENTS

Figure 1:
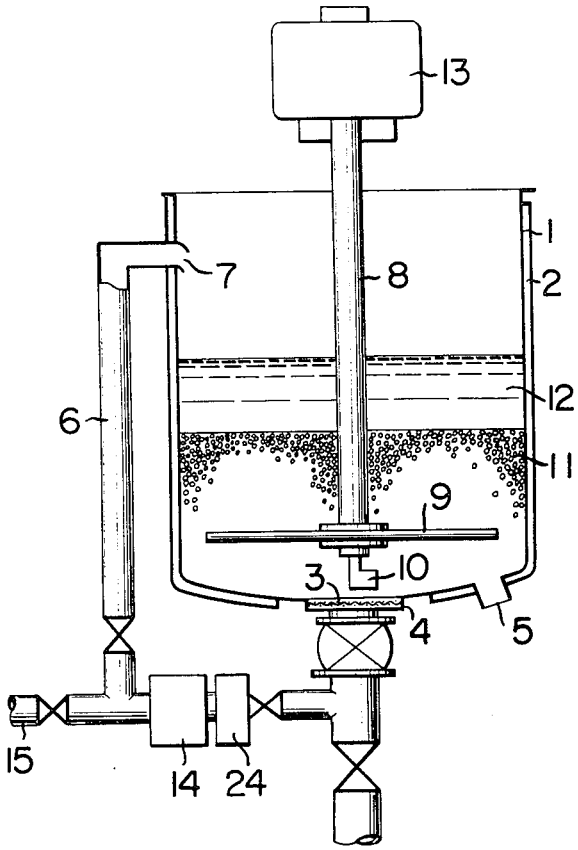
FIG. 1 is a view illustrating a longitudinal section of an embodiment of the apparatus of this invention.

According to the method of this invention, as mentioned above, a suspension and grinding media are charged in a vessel so that the grinding media/suspension volume ratio is within a range of 2.1 to ½, and the mixture of the suspension and grinding media is agitated by an agitation rod rotated at a peripheral velocity of 6 to 20 m/sec, whereby solid particles in the suspension can be dispersed uniformly and finely in the liquid.

By the term "suspension" used herein is meant a liquid containing solid particles, which is treated in the paint, ink, food and cosmetic industries, etc.

Grinding media to be used in this invention can take a spherical, cylindrical or similar form, but the shape of the grinding media is not limited to such form. In other words, grinding media of an indefinite shape or form can be used in this invention as long as they have no extreme convexities or concavities.

As the media-constituting material, there can be mentioned, for example, metals and metal compounds such as alumina and steel, and synthetic and natural ceramics such as glass, porcelain, flint, silica sand and zircon.

It is preferred that grinding media having a maximum length or average particle size of about 1 to about 5 mm are employed.

The greater the specific gravity of the grinding media, the better the dispersing effect. At a high specific gravity, however, a high resistance is imposed on the agitation rod, resulting in increase of the power load. Therefore, it is preferred that the grinding media have a specific gravity of 2 to 8.

Some grinding media cause contamination or discoloration of the suspension depending on the ball-constituting material. In case contamination or discoloration is not significant, grinding media composed of steel can be used, but in the case of a suspension in which contamination or discoloration is not desired, it is preferred to use glass beads, alumina balls, zircon sand or synthetic ceramics.

In this invention, it is preferred that a combination of grinding media of a relatively large particle size (for example, and average particle size of 3 to 5 mm) with grinding media of a relatively small particle size (for example, an average particle size of 1 to 2.5 mm) be employed. In this case, the mixing weight ratio of large media to small media is within a range of from 1/9 to 5/5, preferably from 2/8 to 4/6. In this case, it is construed that solid particles having a relatively large size are dispersed by large media and solid particles having a relatively small size are dispersed by small media, whereby the dispersing effect can be enhanced.

In this invention, it is indispensable that the suspension be mixed with grinding media so that the grinding media/suspension volume ratio is within a range of from 2/1 to ½. As the proportion of the grinding media increases in the mixture of the grinding media and the suspension, the dispersing efficiency is increased, but when the proportion of the grinding media becomes too great, abrasion of the grinding media is extreme and abrasion of the agitation rod or vessel is also made conspicuous. Therefore, it is not preferred that the proportion of the grinding media be increased beyond the above range. It is most preferable that the mixing volume ratio of grinding media/suspension is about 1, more specifically 1.4/1 to 1/1.4.

As regards the charging method, it is desired into this invention that a liquid be first charged in a vessel packed with grinding media while rotating an agitation rod at a low speed and then solid particles be charged into the vessel.

After the suspension and grinding media have been charged into the vessel so that the above-mentioned mixing volume ratio can be attained, the contents of the vessel are agitated.

The agitation is performed by agitation means having one agitation rod. One of the important features of this invention is that the agitation is accomplished by employing one agitation rod having a simple configuration. In the case of the conventional agitation rod of a complicated shape provided with a baffle board or the like, it has been found that turbulent flows are formed by rotation of the agitation rod and the operation efficiency is rather reduced by such turbulent flows. In contrast, in the case of the agitation rod of this invention having a simple shape, laminar flows are formed by rotation of the agitation rod, and it is construed that the operation efficiency and dispersing effect can be improved by such laminar flows. The agitation rod is so rotated that the peripheral velocity of the tip end of the agitation rod is at least 6 m/sec, preferably 6 to 20 m/sec.

To the dispersing step of the method of this invention, in order to prevent reduction of the quality of the suspension, it is preferred that cooling water be passed through a jacket provided on the outside of the vessel. Further, in the charging and dispersing steps, the liquid acting as the dispersion medium or the suspension is circulated in the vessel by means of a circulation pump. The thus dispersed suspension is passed through a separating net after termination of the dispersing step while rotating the agitation rod at a low speed, and the suspension is thus separated from the grinding media and withdrawn from the dispersion apparatus.

At this withdrawing step, if the viscosity of the suspension is high, the suspension sticks to the inner face of the vessel or the surfaces of the grinding media, and it is sometimes difficult to withdraw the suspension from the dispersion apparatus smoothly. In such case, about ⅔ of the suspension is first withdrawn from the apparatus, and a small amount of the liquid used as a dispersion medium, such as a solvent or liquid resin, is added to the vessel, and the remainder of the suspension is then withdrawn in a state diluted with such liquid.

The resulting, colloidally dispersed suspension is transferred to another vessel or to a tank through a pipe line or the like, and it is used as a final product, mixed with other material or stored.

Preferred embodiments of the apparatus used in this invention will now be described by reference to the accompanying drawings.

Referring to FIG. 1, a cylindrical vessel 1 has on the periphery thereof a jacket 2 for adjusting the temperature of the suspension, and opening 3 for withdrawal of the suspension, a screen separating screen 4 for separating the suspension from grinding media, and an opening 5 for withdrawal of grinding media. One agitation rod 9 is mounted at a lower part of the central portion of the vessel at a right angle to an agitation shaft 8, and a drive device 13 is so disposed as to move the agitation rod freely so that the peripheral velocity of the tip end of the agitation rod is within a range of 6 to 20 m/sec, preferably 10 to 15 m/sec. Grinding media 11 are packed in the cylindrical vessel 1.

The vessel 1 may be of any of the fixed or moving type, and the volume of the vessel 1 is within a range of 1 to 10,000 liters. The temperature-adjusting jacket 2 is provided mainly for cooling for preventing increase of the temperature of the suspension at the dispersing step. The jacket 2 covers the entire bottom face of the vessel except the withdrawal opening and it also covers the outside of the vessel from the bottom face to a height corresponding to about 70% of the total height of the vessel. Thus, the object of preventing the temperature increase of the suspension can be attained. The thickness of the jacket is about 5 cm and it can be formed by winding a pipe or the like spirally on the vessel surface.

In the dispersion apparatus having the above-mentioned structure, the starting materials are charged from above, and during the dispersing operation, the suspension 12 which has passed through the withdrawal opening 3 and screen 14 is introduced into a circulation pipe 6 by means of a pump 14 and returned into the vessel via a circulation opening 7. When the suspension 12 is withdrawn from the apparatus, it is fed to a recovery opening 15 by means of the pump 14.

When the suspension 12 is circulated or recovered from the apparatus, it sometimes happens that the density of the grinding media 11 increases in the vicinity of the withdrawal opening 3 and it becomes difficult to perform circulation or recovery of the suspension. In such case, good results can be obtained when a grinding media-scraping vane 10 is provided below the agitation shaft. It is preferred that the scraping vane be provided vertically or with a certain angle to the bottom face of the vessel and have such a shape as shown in the drawings.

In the case of a relatively small vessel, for example, a vessel having a capacity of 1 to 1,000 liters, during the separating step the suspension can be separated from the grinding media in a short time if the vessel per se is rotated at 300 to 800 rpm.

Figure 18:
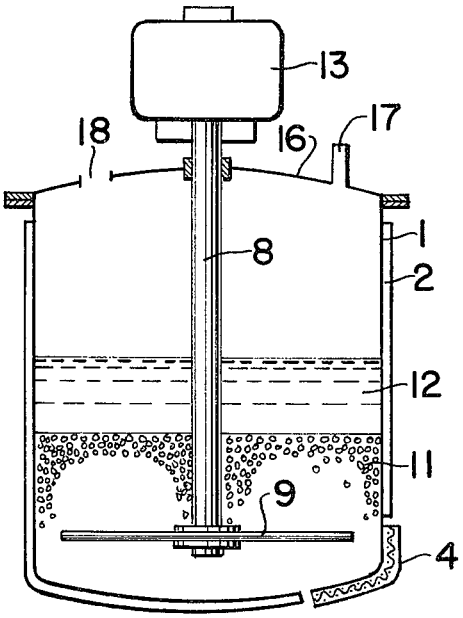
FIG. 18 is similar to FIG. 1 but showing a modified arrangement thereof.
Figure 19:
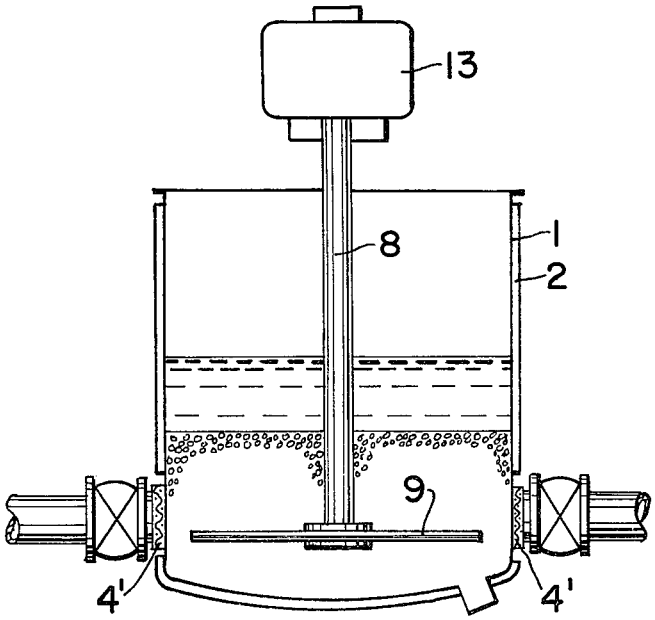
FIG. 19 is similar to FIG. 1 but showing a further modification thereof.

In the drawings, the mesh screen 4 is disposed on the bottom of the vessel, but in this invention, it is possible to dispose the mesh screen 4 on the side face of the vessel as shown in FIG. 18. In FIG. 1, the mesh screen 4 is provided on the bottom face of the vessel 1 just below the agitation shaft 8, is preferred however as shown in FIG. 19 that the center of the mesh screen be disposed below the tip end of the agitation rod 9 and the diameter or length of the screen extend over a distance corresponding to 10 to 50%, especially 25 to 35%, of the total length of the agitation rod. In such case, the movement of the grinding media is most vigorous in the vicinity of the tip end of the agitation rod, and a high separation efficiency can be attained. In case the length of the agitation rod is great, the mesh screen is spread from the bottom of the vessel to the side face thereof.

In order to increase the separation efficiency, it is possible to provide the mesh screen so that it covers the entire bottom face of the vessel, but in view of the abrasion and strength of the screen, it is preferred that the screen be so disposed as to cover 10 to 50% of the bottom area of the vessel.

In order to prevent destruction of the screen by abrasion or the like and subsequent destruction of the pump by flow-out of the grinding media, it is possible to provide another screen having a mesh size of 500 to 3350 microns in the pipe line between the vessel and pump.

In this invention, provision of the above-mentioned mesh screen can be omitted. In this case, after the dispersing step, the suspension is withdrawn from the vessel together with the grinding media, and the mixture is separated into the solid portion (grinding media) and the liquid portion (suspension) by means of a centrifugal separator or the like. Thus, the suspension is recovered in a state free of the grinding media.

Figure 2:
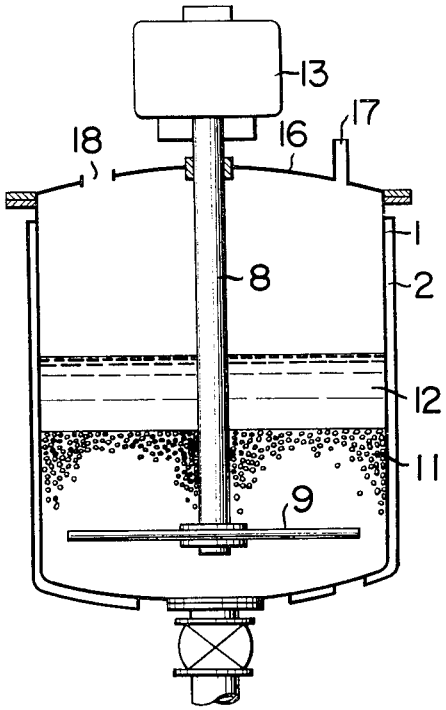
FIG. 2 is a view illustrating a longitudinal section of another embodiment of the apparatus of this invention.

In this invention, as is illustrated in FIG. 2, it is possible to provide a sealable lid 16 having an opening 18 for charging the raw material and an opening 17 for feeding gas under pressure. By provision of such lid, scattering of the solvent vapor can be prevented, and the recovery rate of the suspension can be heightened by feeding air or inert gas under pressure from the opening 17.

In the apparatus of this invention, the dispersion efficiency can be further enhanced by provision of the following auxiliary means.

For instance, after the dispersion, the suspension can be passed through an auxiliary means 24 which can be (1) an ultrasonic device having a frequency of 20 to 200 KHZ and an output of 500 to 1,000 W, (2) a high-speed agitator (homogenizer) rotated at 1,000 to 10,000 rpm and/or (3) a shearing device such as a colloidal mill rotated at 250 to 2,500 rpm. The production rate can be further increased by employing such auxiliary means, and the quality of the suspension can be further improved.

Figure 3A:
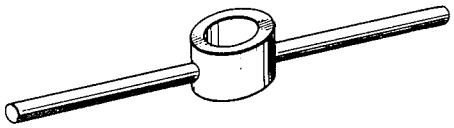
FIG. 3A shows an example of the agitation rod used in this invention.
Figure 3B:
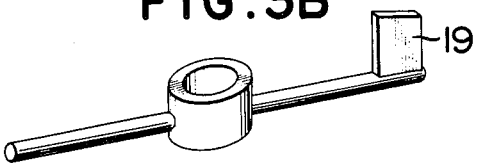
FIG. 3B shows a comparative example of an agitation rod provided with a baffle board at the tip thereof.
Figure 3C:
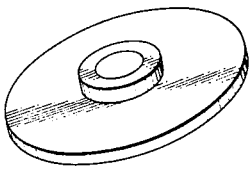
FIG. 3C shows a comparative example of an agitation disc.

Several different types of agitation rods are shown and FIG. 3A shows the agitation rod of the invention, FIG. 3B shows a comparative example of an agitation rod provided with a baffle board 19 and FIG. 3C shows a comparative example of a disc-like (vane-like) agitation member. Results of the comparative tests using these agitation members are illustrated in the Examples given hereinafter.

As is shown in FIG. 3A, in this invention, it is most preferable that the agitation shaft be positioned at the center of the agitation rod when but the agitation shaft is offset from the center of the agitation rod toward the right or left side, namely the length of the agitation rod is different to some extent between the right and left sides, is included in the scope of this invention.

Figure 4:
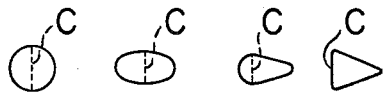
FIG. 4 is a view showing an example of the sectional shape of the agitation rod used in this invention.

FIG. 4 shows examples of the sectional configuration of the agitation rod of this invention, and in this figure, C indicates the line along which the thickness of the agitation rod referred to herein is measured.

Figure 5A:
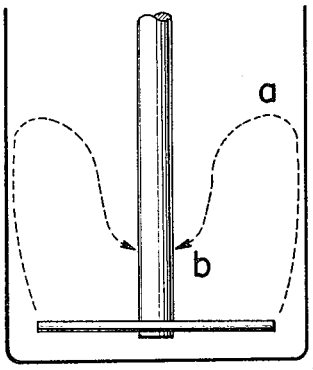
FIGS. 5A and 5B show the fluidized state of a mixture of the suspension and grinding media in the vessel of the apparatus of this invention.
Figure 5B:
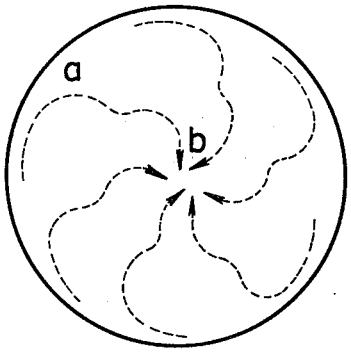

FIG. 5 shows the fluidized state of the suspension in the cylindrical vessel of the apparatus of this invention. In the case of the conventional apparatus provided with two or more discs or agitation rods having a baffle board or the like, convection currents such as shown in FIG. 5 are not formed in the dispersion vessel.

Figure 6:
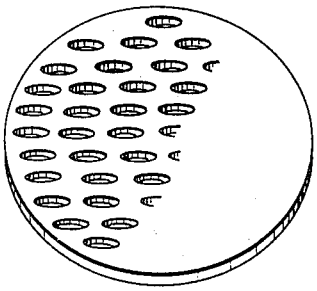
FIG. 6 shows an example of the shape of the mesh screen used in this invention.

FIG. 6 shows the mesh shape and arrangement of the mesh screen shown in FIG. 1.

According to the above-mentioned method and apparatus of this invention, the defects involved in the conventional techniques can be overcome or at least reduced conspicuously.

Figure 17:
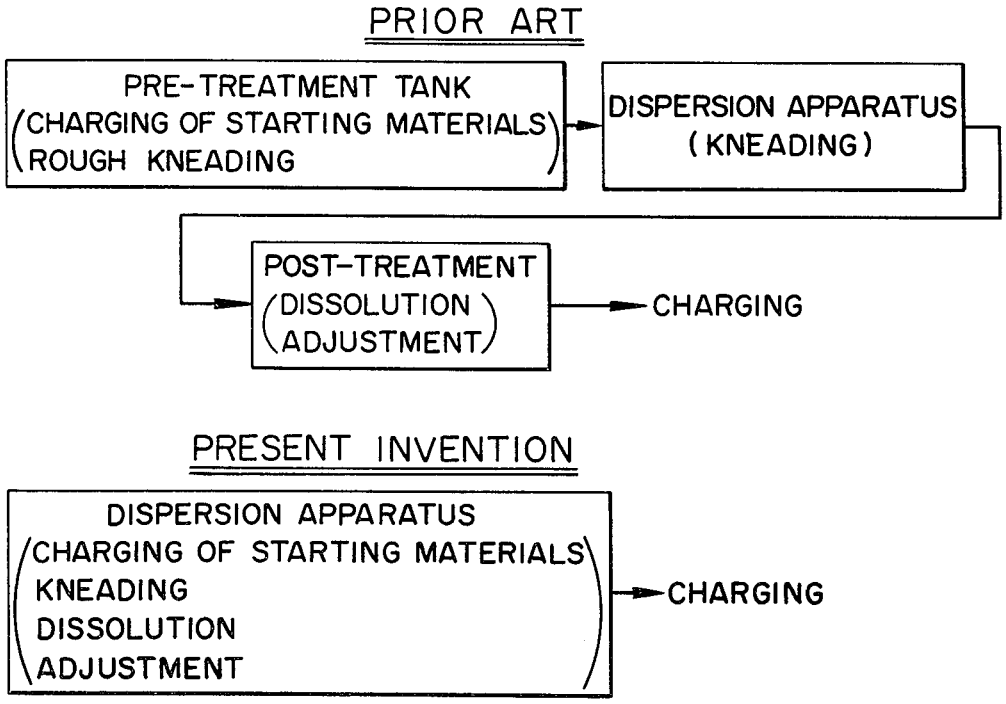
FIG. 17 is a flow diagram comparing the steps of the method of this invention with the steps of the conventional method.

Advantages of the method and apparatus of this invention over the conventional techniques are as follows:

1. According to this invention, the pre-treatment step, dispersing step and post-treatment step can be accomplished in one vessel, and therefore, the manufacturing process and equipment can be simplified and the equipment cost and space can be reduced (see FIG. 17).

2. In this invention, sufficient dispersing effects can be obtained by employing grinding media of a relatively low density such as glass beads and one agitation rod of a very simple structure. Accordingly, no great power is required for agitation and an apparatus having a large capacity such as 6,000 to 10,000 liters can be constructed and used conveniently. Further, since the apparatus per se has a simple structure, the equipment cost can be reduced by 20 to 50% as compared with the conventional Attritor or sand mill. Still further, consumption of energy for treating a unit volume of the batch also be reduced.

3. In case a variety of products are prepared in small quantities (such as coloring compositions for formation of paints), by providing an agitation apparatus having one agitation rod and small-capacity moving tanks for respective products (each being packed with dispersing balls), the production can be accomplished with ease without any particular trouble in the change-over of the kinds of products, and the equipment cost and production space can be reduced. In this case, respective moving tanks can also be used as storage tanks, and it is possible to gradually supply raw materials into the tanks to compensate for the amounts of the raw materials used.

4. The temperature increase is small at the dispersing step and the temperature can be controlled sufficiently. Accordingly, no deviation is brought about as regards the product quality and even a suspension having a high temperature sensitivity can be dispersed sufficiently and conveniently.

5. The viscosity of the suspension to be treated is not particularly critical, and suspensions having a viscosity within such a broad range as 1 to 140 KU (as measured by a Stormer viscometer) can be dispersed according to this invention.

When this invention is compared with the conventional techniques such as those as mentioned in the description of the prior art hereabove as regards the actual operation of dispersion of paints, the results such as shown in Tables 1 and 2 are obtained.

Table 1

| Kind of Suspension | Paint Manufacturing Rate (Kg/hr) This Invention 400 liter Capacity | 2,000 liter Capacity | Conventional Technique Attritor(500 liter capacity) | Sand Mill (120 liter capacity |
|---|---|---|---|---|
| Chlorinated rubber type synthetic resin paint (viscosity = 100 KU, non-volatile content = 50%) | 230 | — | 113 | 84[1)] |
| Acrylic type synthetic resin paint (viscosity = 120 KU, non-volatile content = 58%) | 260 | — | 192 | 43[1)] |
| Vinyl type synthetic resin paint (viscosity = 120 KU, non-volatile content = 38%) | 666 | 1450 | 177 | 19[1)] |
| Synthetic resin mixed paint (white) (viscosity = 120 KU, non-volatile content = 70%) | 600 | 1700 | not applicable to white paint because of contamination | 500 |

Note:
[1)]:sand mill is not ordinarily employed because the viscosity is too high or the paint is quick-drying.

Table 2

| | Attritor (capacity) 300 | 467 | 1,135 | This Invention (capacity) 400 | 1,000 | 2,000 | 6,000 |
|---|---|---|---|---|---|---|---|
| Power (HP) of Motor | 7.5 | 15 | 50 | 7.5 | 30 | 50 | 100 |
| Electric Power Consumption (KW) | 5.5 | 11.3 | 37.5 | 5.5 | 22.5 | 37.5 | 75 |
| Provision of Pre-treatment Tank for Preliminary Kneading of Suspension and Post-treatment Tank for Mixing and Preparing Paint | necessary | | | not necessary | | | |

As is apparent from Table 1, the application range of the sand mill is greatly limited by the kind, viscosity and properties of the paint, and the Attritor cannot be used for a white paint because of contamination.

Further, as is apparent from Table 2, in the case of the Attritor, the size of the vessel is limited because of a high power load, and provision of such accessory means as a pre-treatment tank is indispensable.

These defects involved in the conventional sand mill and Attritor can be completely overcome in this invention, and the power consumption per unit volume of the batch is very low in this invention. Further, this invention is characterized in that the application range of the apparatus is almost totally unlimited by the kind and viscosity of the suspension and other factors and provision of accessory means for preliminary kneading or color adjustment is quite unnecessary.

When the apparatus of this invention is applied to preparation of paints, by virtue of the above characteristics, paints of improved properties capable of giving coatings excellent in various properties such as gloss can be obtained.

Furthermore, when this invention is applied in the fields cosmetics, foodstuffs and the like, similar effects can be attained as in the case of paints.

Accordingly, the method and apparatus of this invention are industrially very valuable for dispersing suspensions into the finely divided colloidal state.

Criticalities of numerical limitations of this invention will be apparent from the description given hereinafter by reference to Examples and accompanying drawings.

This invention will now be described in more detail by reference to the following Examples. Paints in which high dispersion of pigment particles is a critical requirement were used in these Examples as suspensions to be dispersed. Namely, paints shown in Table 3 were used in these Examples.

Table 3

| | Paint Composition and Viscosity | | |
|---|---|---|---|
| | Composition 1 | Composition 2 | Composition 3 |
| Titanium oxide | 36.0 parts by weight | 38.0 parts by weight | 38.5 parts by weight |
| Extender pigment | 27.0 parts by weight | 28.5 parts by weight | 29.0 parts by weight |
| Long oil alkyd resin varnish | 22.0 parts by weight | 23.2 parts by weight | 23.5 parts by weight |
| Additive | 0.5 part by weight | 0.5 part by weight | 0.5 part by weight |
| Solvent | 14.5 parts by weight | 9.8 parts by weight | 8.5 parts by weight |
| Total | 100.0 parts by weight | 100.0 parts by weight | 100.0 parts by weight |
| Viscosity, KU (as measured at 25°C. by Stormer viscometer) | 90 | 110 | 120 |

EXAMPLE 1

Figure 7:
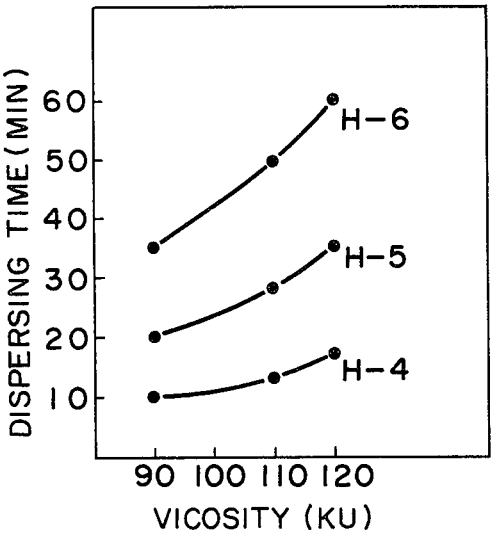
FIG. 7 is a graph showing the relation of the viscosity of the suspension, the dispersing time and the size of dispersed particles.

Each of paint composition 1 (having a viscosity of 90 KU as measured at 25°C.), paint composition 2 (having a viscosity of 110 KU as measured at 25°C.) and paint composition 3 (having a viscosity of 120 KU as measured at 25°C.) shown in the above Table 3 was dispersed under conditions indicated in Table 4 given below until the prescribed particle size could be attained in the dispersed suspension. Obtained results are shown in FIG. 7. The size of the dispersed particles is expressed in terms of the value determined by Hegmann scale (H scale) such as H-4, H-5 and H-6. (In the subsequent Examples, the particle size is indicated by this value.)

As is apparent from the results shown in FIG. 7, suspensions having a relatively high viscosity could be dispersed to the prescribed fine particle size in a short time.

Table 4

| Item | Prescribed Condition |
|---|---|
| 1. Dimension of cylindrical vessel of apparatus | 400 liter capacity, 700 mm inner diameter, 1000 mm height |
| 2. Shape of agitation rod | column |
| 3. Length of agitation rod | 60 cm |
| 4. Diameter of agitation rod | 2 cm |
| 5. Position of attachment of agitation rod | 7 cm from bottom of cylindrical vessel |
| 6. Number of agitation rod | one |
| 7. Material of grinding media | glass beads |
| 8. Particle size of grinding media | 2 mm($\phi$) |
| 9. Amount charged of grinding media | 110 liter |
| 10. Rotation rate | 400 rpm |
| 11. Peripheral velocity | 12.56 m/sec |
| 12. Amount charged of suspension | 110 liter |
| 13. Total amount charged of suspension and grinding media | 220 liter |
| 13. Grinding media/suspension volume ratio | 1/1 |
| 15. Circulation of charged suspension (at least one circulation) | effected |

EXAMPLE 2

The suspension of the paint composition 2 (paint composition 2 was used in subsequent Examples unless otherwise indicated) was dispersed to the prescribed dispersed particle size under the same conditions as shown in Table 4 except that the length of the agitation rod 9 was changed to one corresponding to 65%, 75%, 85% or 95% of the inner diameter of the cylindrical vessel 1. The time required for obtaining the prescribed dispersed particle size was measured to obtain results shown in FIG. 8.

Figure 8:
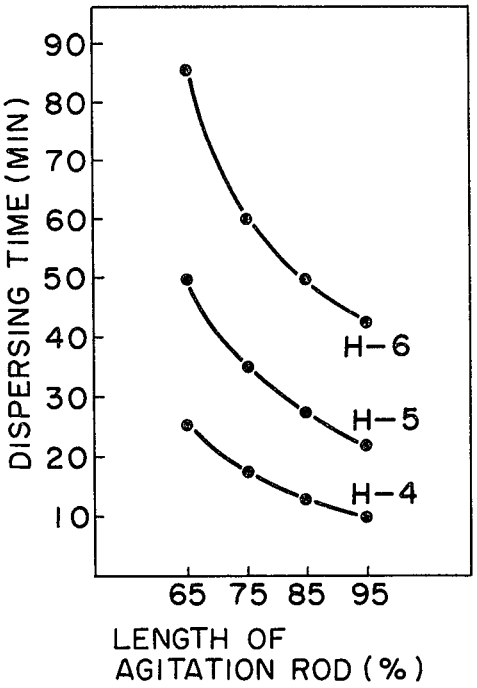
FIG. 8 is a diagram illustrating the relation among the length of the agitation rod (expressed in terms of the ratio to the inner diameter of the cylindrical vessel), the dispersing time and the size of dispersed particles.

The results shown in FIG. 8 indicate that the dispersion can be accomplished effectively when the agitation rod 9 has a length corresponding to 65 to 95% (preferably 75 to 95%) of the inner diameter of the cylindrical vessel 1. It was found that when the length of the agitation rod 9 is shorter than 65% of the inner diameter of the cylindrical vessel 1, the time required for dispersion is abruptly prolonged.

Similar results were obtained when supensions of other compositions were employed.

EXAMPLE 3

The time required for obtaining the prescribed dispersed particle size was determined by performing the dispersion by employing the agitation rod of a shape shown in FIG. 3A (this invention), a comparative baffle board-provided agitation rod shown in FIG. 3B and a disc shown in FIG. 3C, respectively. Obtained results are shown in FIG. 9.

The paint composition 2 was used as the suspension and conditions other than that of the starting rod were the same as shown in Table 4.

Figure 9:
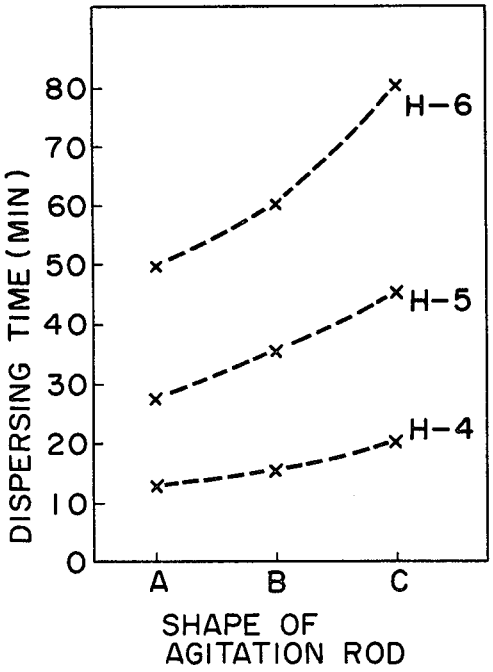
FIG. 9 is a graph illustrating the influences of the shape of the agitation rod such as shown in FIGS. 3A to 3C on the dispersing time and size of dispersed particles.

As is apparent from the results shown in FIG. 9, a rod of a simple structure such as the agitation rod of this invention shown in FIG. 3A gives the highest dispersion efficiency (the shortest dispersing time) and in the case of a disc-like agitator or an agitation rod provided with a baffle board the efficiency is rather reduced.

EXAMPLE 4

The dispersion was conducted under the same conditions as indicated in Table 4 except that the number of the agitation rod 9 was increased from one to two, three or more and the rods were disposed in parallel with each other and with a right angle to the agitation shaft. It was found that with increase of the number of agitation rods the dispersing time and power load increased. For example, if the number of the agitation rod was increased from one to two or three, the dispersing time was 1.5 to 2 times prolonged.

In Examples 3 and 4, the following matters were observed.

In the case of the agitation rod of this invention the mixture of the suspension and grinding media flowed in the cylindrical vessel while forming a definite laminar flow, as shown in FIG. 5, and as the head from the point *a* to the point *b* was greater, a better dispersing effect was obtained with a smaller power load.

When the shape of the agitation rod or vane was complicated (as shown in FIG. 3B or 3C or when the number of the agitation rod 9 was increased, a greater power load was imposed and the head from the point *a* to the point *b* became small to cause turbulent flows in parts of the mixture of the suspension and grinding media. Further, in such case, the temperature elevation was extreme.

From the foregoing results it was found that when the agitation vane has a simplest shape, namely a rod-like shape as in this invention, and the number of such agitation rod is one, a highest dispersing effect can be obtained with a minimum power load.

EXAMPLE 5

The dispersion was conducted by changing the sectional shape of the agitation rod 9 from circle to oval, modified oval, triangle or the like such as shown in FIG. 4. Similar results were obtained.

From the following experiment, it was confirmed that it is indispensable that the thickness (line C in FIG. 4) of the agitation rod should be 2/100 to 5/100 of the length of the agitation rod.

Figure 10:
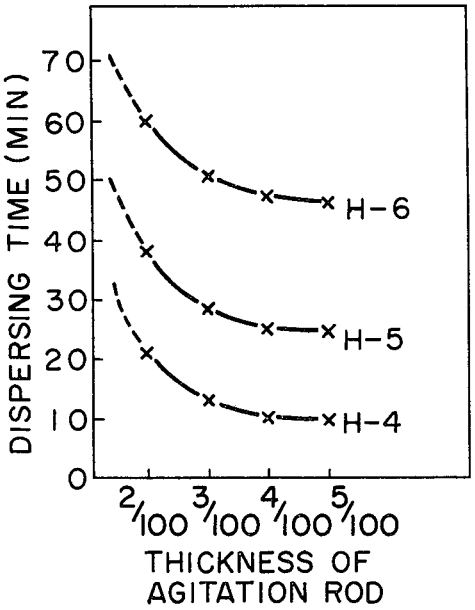
FIG. 10 is a graph illustrating the influences of the thickness of the agitation rod (expressed in terms of the ratio to the length of the agitation rod) on the dispersing time and size of dispersed particles.
Figure 11:
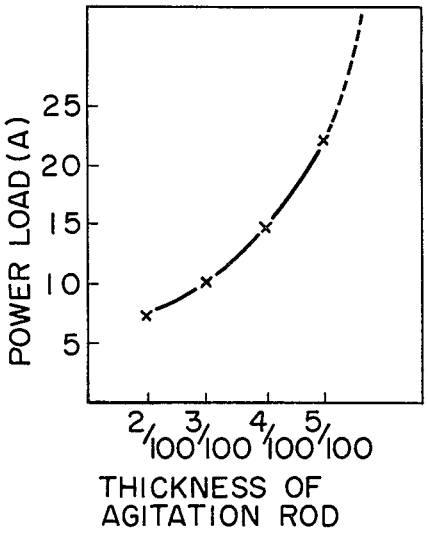
FIG. 11 is a graph illustrating the influence of the thickness of the agitation rod (expressed in terms of the ratio to the ratio to the length of the agitation rod) on the power load.

The suspension was dispersed under the same conditions as indicated in Table 4 by changing the thickness of the agitation rod and the dispersing time and power load were determined to obtain results shown in FIGS. 10 and 11, from which it was found that when the thickness of the agitation rod is within a range of 2 to 5% of the length of the agitation rod, the dispersing time can be shortened and the power load can be reduced. From the results shown in FIG. 10, it is seen that when the thickness of the agitation rod is smaller than 2% of the length of the agitation rod, the dispersing time is abruptly prolonged, and from the results shown in FIG. 11, it is seen that when the thickness of the agitation rod is larger than 5% of the length of the agitation rod, increase of the power load is extreme. Similar results were obtained in the case of suspensions of other compositions.

EXAMPLE 6

The suspension was dispersed under the same conditions as indicated in Table 4 by employing the same agitation rod 9 as used in Example 1 and changing the height of the attachment point of the agitation rod to 5, 10, 15 or 20% of the inner diameter of the cylindrical vessel 1. Obtained results are shown in FIG. 12.

Figure 12:
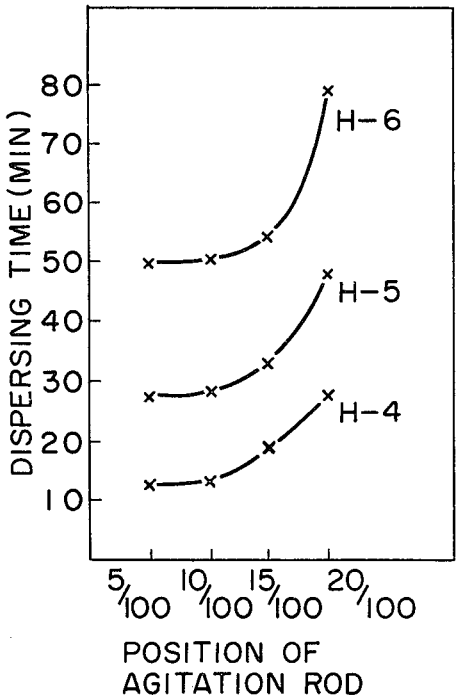
FIG. 12 is a graph illustrating the influence of the position of the agitation rod (expressed in terms of the ratio of the height of the position of the agitation rod from the vessel bottom to the inner diameter of the cylindrical vessel) on the dispersing time and size of dispersed particles.

From the results shown in FIG. 12, it was found that the dispersing time can be shortened when the height of the attachment point of the agitation rod is 5 to 20%, preferably 5 to 15%, of the inner diameter of the cylindrical vessel. Thus, it was confirmed that a better dispersing effect can be obtained as the attachment position of the agitation rod is closer to the bottom of the vessel but when the attachment position is too close to the vessel bottom, abrasion of the separating net and vessel wall is caused. Similar results were obtained in the case of suspensions of other compositions.

EXAMPLE 7

The suspension was conducted under the same conditions as indicated in Table 4, and the case in which circulation of the suspension was effected was compared with the case where the circulation was not effected, to obtain results shown in Table 5.

Table 5

| Dispersed particle size | Dispersing Time Required: Circulation was effected | Dispersing Time Required: Circulation was not effected |
|---|---|---|
| H-5 | 28 minutes | 30 minutes |
| H-6 | 50 minutes | 70 minutes (presence of coaser particles was observed) |

From the above results, it is seen that the dispersing time can be shortened if the suspension is circulated during the dispersion operation.

EXAMPLE 8

Dispersion tests were repeated under the same conditions as indicated in Table 4 while changing the position of an opening 3 for separating grinding media 11 from the suspension, the area of said opening and the shape of a mesh screen 4. From the results, it was found that the separating opening 3 may be disposed on either the bottom or side of the cylindrical vessel 1 but it is preferred that the opening 3 is disposed on the bottom in a circle concentric to the vessel bottom having a diameter not larger than ¼ of the inner diameter of the vessel bottom and in this case a scraping vane 10 such as shown in FIG. 1 is provided to prevent clogging of the opening 3 with the grinding media. It was also found that when a highly viscous liquid such as the suspension of the paint composition 2 is treated, the area of the separating opening 3 is at least 5% of the area of the bottom of the vessel, and that good results are obtained when the mesh screen has a perforated shape such as shown in FIG. 6 and holes of the screen have a width of 0.4 to 0.7 mm and a length about 5 to about 10 times the width thereof.

EXAMPLE 9

Figure 13:
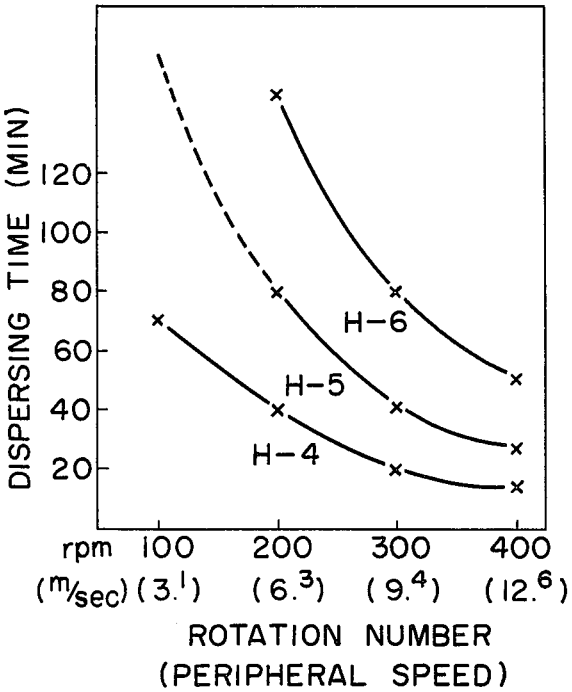
FIG. 13 is a graph illustrating the influences of the rotation number (peripheral velocity) on the dispersing time and size of dispersed particles.

The suspension was dispersed under the same conditions as indicated in Table 4 except that the rotation number (peripheral velocity) was changed variously, and the time required for obtaining the prescribed dispersed particle size was measured to obtain results shown in FIG. 13, from which it is seen that the lower limit of the peripheral velocity is 6 m/sec and at a peripheral velocity lower than this limit the dispersing time is abruptly prolonged, and that if the peripheral velocity is heightened beyond 15 m/sec, no drastic shortening of the dispersing time can be attained. Similar results were obtained in the case of suspensions of other compositions.

EXAMPLE 10

Figure 14:
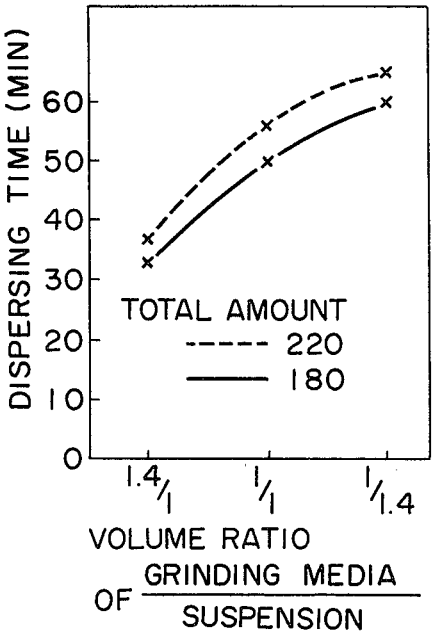
FIG. 14 is a graph illustrating the relation between the grinding media/suspension volume ratio and the dispersing time.

The suspension was dispersed under the same conditions as indicated in Table 4 except that the ratio of the grinding media and suspension and the total amount charged of the grinding media and suspension were changed, and the dispersing time and the power load were determined to obtain results shown in FIGS. 14 and 15. In the case of suspension of other compositions similar results were obtained.

Figure 15:
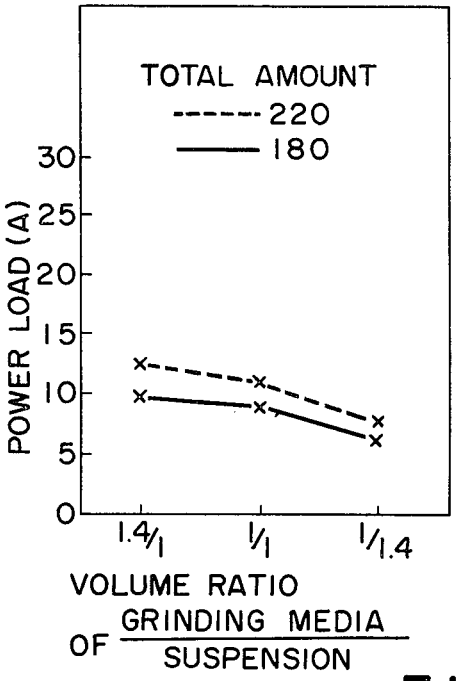
FIG. 15 is a graph illustrating the relation between the grinding media/suspension volume ratio and the power load.

From the results shown in FIGS. 14 and 15, it is seen that best results are obtained when the grinding media/-suspension volume ratio is within a range of from 1.5/1 to 1/1.5.

As a result of examination of the relation between the dispersing effect and the total amount charged of the grinding media and suspension, it is seen that the total amount charged of the grinding media and suspension is within a range of ¼ to ¾ of the capacity of the vessel.

EXAMPLE 11

Figure 16:
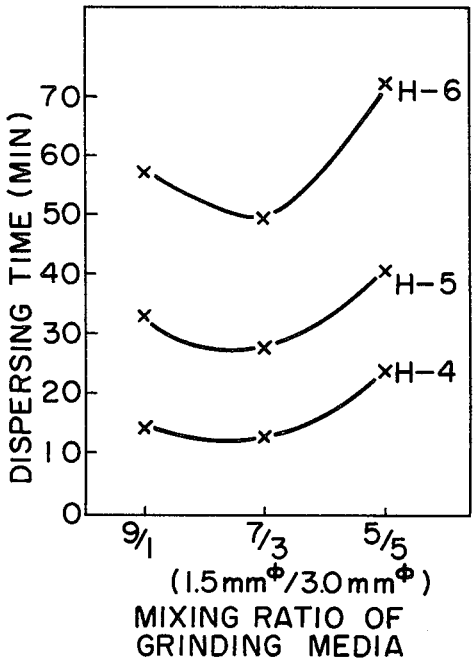
FIG. 16 is graph illustrating the relation between the mixing ratio of grinding media and the dispersing time.

The suspension was dispersed under the same conditions as indicated in Table 4 except that the average particle size of the grinding media (glass beads) and the mixing ratio of the grinding media differing in the particle size were changed, and the dispersing time was measured to obtain results shown in FIG. 16.

From the results shown in FIG. 16, it is seen that the dispersing time can be shortened when grinding media differing in the particle size are mixed at a small particle size media: large particle size media weight ratio ranging from 9/1 to 5/5, as compared with the case where one kind of grinding media having the same particle size are employed.

It was also found that optimum results are obtained when grinding media having a maximum diameter of 1 to 5 mm are employed.

EXAMPLE 12

Procedures of Example 7 were repeated by circulating the suspension through a ultrasonic device having a frequency of 28 KHZ and an output of 200 W. The dispersing effect was further improved by cavitation caused in interfaces among the solid particles and the impinging action. Further, the distinctness and gloss of the coating formed from the resulting suspension were also improved.

EXAMPLE 13

Procedures of Example 7 were repeated by circulating the suspension through a high speed agitator rotated at 6,000 rpm. The dispersing effect was further improved by the shearing action of the agitator, and the gloss of the coating prepared from the resulting suspension was also further improved.

EXAMPLE 14

Procedures of Example 7 were repeated by circulating the suspension through a colloid mill rotated at 1,000 rpm. The dispersing effect was further improved, and the distinctness and gloss of the coating prepared from the resulting suspension were also further improved.

What is claimed is:

1. A method for dispersing suspensions which comprises charging grinding media and a suspension containing solid particles in a vessel so that the grinding media/suspension volume ratio is withing the range of from 2/1 to ½, and agitating the suspension and grinding media by rotating a single agitation rod mounted on the tip end of an agitation shaft at a lower part of the central portion of the vessel so that the peripheral velocity of the tip of the agitation rod is within a range of 6 to 20 m/sec, and a laminar flow is produced in the suspension to thereby disperse the suspension in the colloidal state.

2. A method for dispersing suspensions according to claim 1 wherein said grinding media comprise grinding media having an average particle size of 1 to 2.5 mm and grinding media having an average particle size of 3 to 5 mm at a weight ratio of from 9/1 to 5/5.

3. A method for dispersing suspensions according to claim 1 comprising separating the suspension from the grinding media and then recirculating the grinding media into the vessel.

4. A method of dispersing suspensions according to claim 1 wherein the peripheral speed of the tip of the agitation rod is 10 to 15 m/sec.

5. A method for dispersing suspensions according to claim 1 wherein the total amount charged of the grinding media and suspension is ¼ to ¾ of the volume of the vessel.

6. An apparatus for dispersing suspensions which comprises a vessel, grinding media contained in said vessel, an agitation shaft driven by driving means and disposed in the central portion of said vessel and a single agitation rod mounted on the tip end of the agitation shaft at a right angle to said agitation shaft, such that said agitation rod is disposed at a point spaced vertically from the bottom of the vessel by a distance corresponding to 5 to 20% of the inner diameter of said vessel, the length of said rod corresponding to 65 to 95% of the inner diameter of said vessel and the thickness of said agitation rod being 2 to 5% of the length of the agitation rod, said agitation rod having a peripheral velocity at its tip to produce laminar flow in the suspension.

7. An apparatus set forth in claim 6 comprising a mesh screen mounted over an opening in the vessel to separate the suspension from the grinding media.

8. An apparatus set forth in claim 6 comprising a mesh screen having a diameter corresponding to 10 to 50% of the total length of the agitation rod disposed below the agitation rod, said screen having a center aligned in the tip of the agitation rod.

9. An apparatus set forth in claim 6 wherein the agitation rod has a columnar shape and its diameter is 2/100 to 5/100 of the length thereof.

10. An apparatus set forth in claim 6 wherein the grinding media contained in the vessel have a true specific gravity of 2 to 8 and are composed of a material selected from steel, glass, alumina, zircon and porcelain.

* * * * *